United States Patent [19]

Maus et al.

[11] Patent Number: 4,948,353

[45] Date of Patent: Aug. 14, 1990

[54] METAL CATALYST CARRIER BODY HAVING A SHORTENED JACKET TUBE AND A METHOD OF PRODUCING THE SAME

[75] Inventors: Wolfgang Maus; Theodor Cyron, both of Bergisch Gladbach, Fed. Rep. of Germany

[73] Assignee: EMITEC Gesellschaft für Emissionstechnologie mbH, Lohmar, Fed. Rep. of Germany

[21] Appl. No.: 144,503

[22] Filed: Jan. 15, 1988

[30] Foreign Application Priority Data

Jan. 15, 1987 [DE] Fed. Rep. of Germany ..... 3701052

[51] Int. Cl.[5] ..... F01N 3/15

[52] U.S. Cl. ..... 422/180; 422/179; 422/221; 422/222; 29/890

[58] Field of Search ..... 422/179, 180, 181, 221, 422/222; 29/451, 455.1, 157 R; 228/183; 428/592, 593

[56] References Cited

U.S. PATENT DOCUMENTS

| | | | |
|---|---|---|---|
| 4,381,590 | 5/1983 | Nonnenmann et al. | 29/157 R |
| 4,795,615 | 1/1989 | Cyron et al. | 422/180 X |
| 4,803,189 | 2/1989 | Swars | 502/527 X |
| 4,814,146 | 3/1898 | Brand et al. | 422/179 |
| 4,832,998 | 5/1989 | Cyron | 428/34.1 X |
| 4,842,954 | 6/1989 | Cyron et al. | 428/593 |

FOREIGN PATENT DOCUMENTS

| | | |
|---|---|---|
| 2746475 | 4/1979 | Fed. Rep. of Germany . |
| 2924592 | 1/1981 | Fed. Rep. of Germany . |
| 3037796 | 5/1982 | Fed. Rep. of Germany . |
| 3603882 | 8/1986 | Fed. Rep. of Germany . |
| 3529654 | 2/1987 | Fed. Rep. of Germany . |
| 2444793 | 7/1980 | France . |

*Primary Examiner*—Robert J. Warden
*Assistant Examiner*—D. John Griffith, Jr.
*Attorney, Agent, or Firm*—Herbert L. Lerner; Laurence A. Greenberg

[57] ABSTRACT

A metal catalyst carrier body assembly and a method of producing the same includes a metal catalyst carrier body having a given length, two end surfaces and a honeycomb structure formed of textured metal sheets through which gas can flow. A jacket tube surrounds the honeycomb structure and is shorter than the given length. At least a portion of the end surfaces is brazed. The jacket tube has ends each being disposed at a distance from a respective one of the end surfaces being greater than the brazed portion.

13 Claims, 1 Drawing Sheet

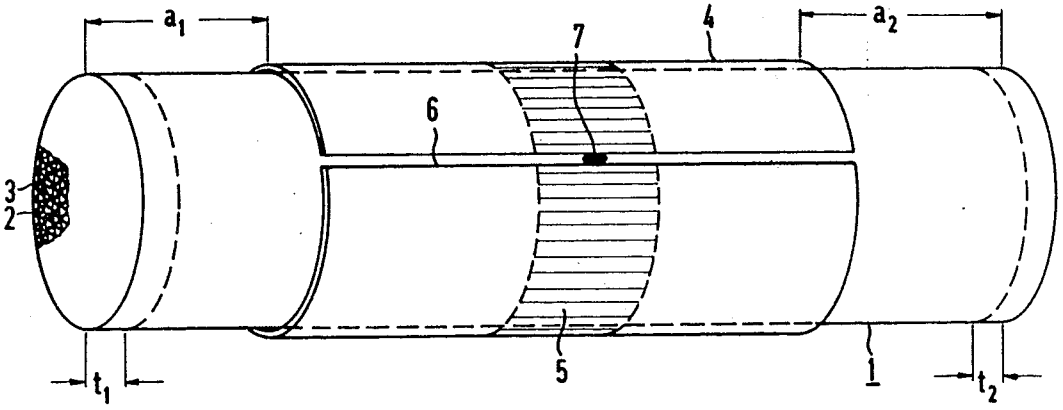
a2
4
7
6
a1
3
2
1
5
t2
t1

METAL CATALYST CARRIER BODY HAVING A SHORTENED JACKET TUBE AND A METHOD OF PRODUCING THE SAME

The invention relates to a metal catalyst carrier body and a method of producing the same, having a honeycomb structure formed of textured metal sheets through which gas can flow, the structure being surrounded by a jacket tube that is shorter than the catalyst carrier body.

Catalyst carrier bodies of this kind, which are preferably used for cleaning the exhaust gas of motor vehicles, are known, for example, from German Published, Non-Prosecuted Applications DE-OS 29 24 592; 30 37 796 and 35 29 654. The catalyst carrier bodies are produced, for example, from spirally wound metal sheets which are disposed one over another, are either alternatingly corrugated and smooth or similarly textured, and are generally provided with a jacket tube.

German Published, Non-Prosecuted Application DE-OS 36 03 882 discloses a catalyst carrier body that has a jacket tube which is shorter on one side than the actual catalyst carrier body itself. This structure is intended in particular as a so-called starting catalyst, which is installed near the engine and therefore is exposed to severe thermal stresses. In the prior art, however, the jacket tube is brazed over its entire length to the outermost layer of the catalyst carrier body and completely surrounds at least one end surface which is also brazed. During axial and radial expansion of a catalyst carrier body of this kind which is known as growth that takes place in these directions, is hindered by the jacket tube, which can result in premature destruction.

It is accordingly an object of the invention to provide a metal catalyst carrier body having a shortened jacket tube and a method of producing the same, which overcomes the hereinafore-mentioned disadvantages of the heretofore-known methods and devices of this general type and which has a prolonged the service life, especially when used as a starting catalyst, due to a suitable construction and fastening of the jacket tube.

With the foregoing and other objects in view there is provided, in accordance with the invention, a metal catalyst carrier body assembly, comprising a metal catalyst carrier body having a given length, two end surfaces and a honeycomb structure formed of textured metal sheets through which gas can flow, a jacket tube surrounding the honeycomb structure and being shorter than the given length, at least a portion of the end surfaces being brazed up to a given depth, the jacket tube having ends each being disposed at a distance before a respective one of the end surfaces being greater than the given depth. Firstly, this structure makes it possible to effect end surface brazing, which does not also simultaneously lead to joining with the jacket tube in the vicinity of the end surfaces. As a result, when subjected to alternating thermal stresses, the radial and axial expansions of the brazed end surfaces are not hindered by a fixed connection with the jacket tube, so that tensile strains, in particular, cannot arise in this vicinity during the cooling process.

The distance by which the jacket tube is spaced apart from the face ends should preferably be considerably greater than the depth of the brazing, so that only a slight bending load on the outer layers occurs in response to alternating thermal stresses.

Therefore, in accordance with another feature of the invention, the depth is several millimeters, and the distance between the ends of the jacket tube and the end surfaces is 5 to 40 mm.

In accordance with a further feature of the invention, the catalyst carrier body has an outermost layer, and the jacket tube is only brazed to the outermost layer at a narrow circumferential zone of the jacket tube covering a narrow strip of the given length of the catalyst carrier body.

In combination with the other features of the invention mentioned above, this not only leads to a reduction in the alternating thermal stresses on the end surfaces, but also enables almost unhindered longitudinal expansion, that is, an unhindered growth of the catalyst carrier body, which can take place over a relatively long period of operation. If the jacket tube is not shortened, such brazing is virtually unattainable for manufacturing reasons, because with end surface brazing, brazing material also generally gets in between the outermost layer of the catalyst carrier body and the jacket tube, thus producing undesirable brazed connections there.

In accordance with an added feature of the invention, the jacket tube extends annularly over approximately only the narrow strip. In such a case, the jacket tube approximately annularly surrounds the very much longer catalyst carrier body. This embodiment is naturally only suitable for later installation situations in which a protective sheathing tube is attached in any case, as is generally true for starting catalysts, for instance. The usual tubes of the exhaust system of an internal combustion engine can be brazed unproblematically onto a jacket tube that has been shortened into a narrow ring, with the overall result being a closed system. Once the exhaust system has been completed, the brazed end surfaces of the catalyst carrier body then protrude self-supportingly into the adjoining tubes, or are supported by the tubes.

In accordance with an additional feature of the invention, the jacket tube has a slightly gaping longitudinal slit formed therein. In accordance with yet another feature of the invention, there is provided at least one weld spanning the longitudinal slit and fixing the jacket tube in at least one or more small regions. These features can be provided in principle even without the other features mentioned above.

In order to manufacture the device, there is provided, in accordance with the invention, a method for producing a catalyst carrier body assembly, which comprises: winding a metal catalyst carrier body with a given length, two end surfaces, an outermost layer and a honeycomb structure formed of textured metal sheets through which gas can flow; spreading open a longitudinal slit in a jacket tube being shorter than the given length, slipping the jacket tube into a given position over the catalyst carrier body with ends of the jacket tube each being disposed at a distance before a respective one of the end surfaces, closing the longitudinal slit, welding the longitudinal slit at least at one point; providing brazing material on at least a portion of the end surfaces; providing brazing material on at least one of the outermost layer and a circumferential zone on the inside of the jacket tube to be brazed; and brazing the catalyst carrier body to the jacket tube.

In accordance with another mode of the invention, there is provided a method which comprises providing the brazing material on at least one of the outermost layer and the circumferential zone with the aid of a material from the group consisting of adhesives, glues and binders.

In accordance with a further mode of the invention, there is provided a method which comprises providing the brazing material on at least a portion of the end surfaces before or after providing the brazing material on at least one of the outermost layer and the circumferential zone.

In accordance with an added mode of the invention, there is provided a method which comprises providing the brazing material on at least a portion of the end surfaces before or after slipping on, closing and welding the jacket tube. It is also possible to provide the brazing material as a foil located between the outermost layer and the circumferential zone.

In accordance with a concomitant mode of the invention, there is provided a method which comprises brazing at least a portion of the end surfaces to a depth of several millimeters, and setting a distance between the ends of the jacket tube and the end surfaces of 5 to 40 mm.

It is accordingly clear that this kind of longitudinally slit jacket tube makes it particularly simple to produce an exact, precisely defined brazed circumferential zone between the jacket tube and the outermost layer of the catalyst carrier body. While brazing material was always distributed in a somewhat undefined manner when the jacket tube was slipped on in the prior art, this can be avoided when the jacket tube is slit. The desired circumferential zone to be brazed is provided with brazing material in powder, paste or foil form, for example, and then the jacket tube is spread open at the longitudinal slit therein and is slipped on without smearing the brazing material. This production method also avoids denting or deformation of the outer layers, which would have a very deleterious effect, particularly in the case of a shortened jacket tube, because the dented layers would protrude beyond one another at either end in an undefined manner. After the spread-open slit is closed again, the jacket tube can be precisely brought to the desired diameter in a suitable calibration device and fixed, such as by means of a spot weld. The other production steps are not hindered by this step. In particular, the end surfaces can be provided with brazing material before or after these steps. An ensuing full welding of the longitudinal slit is unnecessary in many cases, because the tubes of the exhaust gas system can be slipped over the slit jacket tube up to the weld point from both sides. In such a case, the longitudinal slit in fact promotes the evening out of manufacturing tolerances, because it is compressible within certain limits.

Other features which are considered as characteristic for the invention are set forth in the appended claims.

Although the invention is illustrated and described herein as embodied in a metal catalyst carrier body having a shortened jacket tube and a method of producing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the drawing.

The FIGURE of the drawing is a diagrammatic, partly broken-away, perspective view of an embodiment of the invention.

Referring now to the single FIGURE of the drawing in detail, it is seen that the actual catalyst carrier body 1 is formed of alternating layers of spirally wound smooth metal sheets 2 and corrugated or wavy metal sheets 3. Metal sheets which are textured in other ways and form conduits through which gas can flow, may also be used for the present invention. The end surfaces of the catalyst carrier body 1 are brazed to respective depths of parts t1 and t2 of the length of the catalyst carrier body which may be several millimeters. It is not absolutely necessary for the entire end surfaces to be brazed, but instead, only certain regions thereof can optionally be brazed. The catalyst carrier body 1 is surrounded by a shortened jacket tube 4, which terminates at both ends at respective distances a1 and a2 before the end surfaces, which are preferably 5 to 40 mm. The two distances a1, a2 need not necessarily be equal. The jacket tube 4 may be entirely brazed to the outermost layer of the catalyst carrier body 1, or preferably only in a narrow circumferential zone 5 at a narrow strip along the length of the catalyst carrier body, with the optional aid of adhesives, glues or binders. The jacket tube may also only extend annularly over the zone 5. The jacket tube 4 may have a longitudinal slit 6 formed therein (which need not absolutely extend precisely longitudinally), which is preferably fixed at one point by a welded connection 7. The slit is opened in order to slip the jacket tube over the catalyst carrier body 1 and then the slit is closed again and welded.

The radial alternating thermal expansion of the brazed end surfaces is not hindered in the embodiment according to the invention, and as a result the service life thereof is prolonged. The slit jacket tube enables the precise fixation and production of a narrow brazed circumferential zone, as a result of which changes in the length of the catalyst carrier body are not hindered either, which again has a favorable effect on the service life. Additionally, the slit jacket tube hinders denting or displacement of the outermost layers when the jacket tube is slipped on, without requiring other, complicated measures. A catalyst carrier body according to the invention which has a shortened jacket tube, is particularly suitable for use as a starting catalyst in the area near the engine which is exposed to severe alternating thermal stresses.

The foregoing is a description corresponding in substance to German Application P 37 01 052.2, dated Jan. 15, 1987, the International priority of which is being claimed for the instant application, and which is hereby made part of this application. Any material discrepancies between the foregoing specification and the aforementioned corresponding German application are to be resolved in favor of the latter.

We claim:

1. Metal catalyst carrier body assembly, comprising a metal catalyst carrier body having a given length, two end surfaces and a honeycomb structure formed of textured metal sheets through which gas can flow, a jacket tube surrounding said honeycomb structure and being shorter than said given length, at least a portion of said end surfaces being brazed up to a given part of said given length, said jacket tube having ends each being disposed at a distance from a respective one of said end surfaces which is greater than said given part of said given length.

2. Catalyst carrier body assembly according to claim 1, wherein said distance between said ends of said jacket tube and said end surfaces is 5 to 40 mm.

3. Catalyst carrier body assembly according to claim 1, wherein said catalyst carrier body has an outermost layer, and said jacket tube is brazed to said outermost layer at a circumferential zone of said jacket tube covering a narrow strip of said given length of said catalyst carrier body.

4. Catalyst carrier body assembly according to claim 3, wherein said jacket tube extends annularly over approximately only said narrow strip.

5. Catalyst carrier body according to claim 1, wherein said jacket tube has a longitudinal slit formed therein.

6. Catalyst carrier body according to claim 5, including at least one weld spanning said longitudinal slit and fixing said jacket tube in at least one region.

7. Method for producing a catalyst carrier body assembly, which comprises:

forming a metal catalyst carrier body with a given length, two end surfaces, an outermost layer and a honeycomb structure formed of textured metal sheets through which gas can flow;

providing brazing material on at least one of the outermost layer and a circumferential zone on the inside of a jacket tube to be brazed;

subsequently spreading open a longitudinal slit in the jacket tube being shorter than the given length, slipping the jacket tube into a given position over the catalyst carrier body with ends of the jacket tube each being disposed at a distance from a respective one of the end surfaces, closing the longitudinal slit, welding the longitudinal slit at least at one point;

providing brazing material on a portion of the end surfaces;

and;

brazing the catalyst carrier body to the jacket tube.

8. Method according to claim 7, which comprises providing the brazing material on at least one of the outermost layer and the circumferential zone with the aid of a material from the group consisting of adhesives, glues and binders.

9. Method according to claim 7, which comprises providing the brazing material on at least a portion of the end surfaces before providing the brazing material on at least one of the outermost layer and the circumferential zone.

10. Method according to claim 7, which comprises providing the brazing material on at least a portion of the end surfaces after providing the brazing material on at least one of the outermost layer and the circumferential zone.

11. Method according to claim 7, which comprises providing the brazing material on at least a portion of the end surfaces before slipping on, closing and welding the jacket tube.

12. Method according to claim 7, which comprises providing the brazing material on at least a portion of the end surfaces after slipping on, closing and welding the jacket tube.

13. Method according to claim 7, which comprises setting a distance between the ends of the jacket tube and the end surfaces of 5 to 40 mm.

* * * * *